US009017113B2

(12) United States Patent
Haga

(10) Patent No.: US 9,017,113 B2
(45) Date of Patent: Apr. 28, 2015

(54) FEMALE TERMINAL FITTING

(71) Applicant: Sumitomo Wiring Systems, Ltd., Yokkaichi, Mie (JP)

(72) Inventor: Koukichi Haga, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 151 days.

(21) Appl. No.: 13/657,346

(22) Filed: Oct. 22, 2012

(65) Prior Publication Data

US 2013/0109250 A1 May 2, 2013

(30) Foreign Application Priority Data

Nov. 2, 2011 (JP) ..... 2011-241473

(51) Int. Cl.
*H01R 13/11* (2006.01)
*H01R 13/03* (2006.01)
*H01R 43/00* (2006.01)

(52) U.S. Cl.
CPC ..... *H01R 13/11* (2013.01); *H01R 13/03* (2013.01); *H01R 43/00* (2013.01)

(58) Field of Classification Search
USPC ..... 439/816, 825, 852, 851, 886
See application file for complete search history.

(56) References Cited

U.S. PATENT DOCUMENTS

| | | | | |
|---|---|---|---|---|
| 5,106,329 | A * | 4/1992 | Maeshima et al. | 439/851 |
| 6,024,612 | A * | 2/2000 | Myer et al. | 439/852 |
| 6,183,885 | B1 * | 2/2001 | Nakamura et al. | 428/647 |
| 6,328,615 | B1 | 12/2001 | Safai | |
| 6,379,199 | B1 * | 4/2002 | Chen | 439/852 |
| 6,475,040 | B1 * | 11/2002 | Myer et al. | 439/852 |
| 6,500,032 | B2 * | 12/2002 | Endo et al. | 439/857 |
| 6,547,608 | B2 | 4/2003 | Sato et al. | |
| 7,195,495 | B2 | 3/2007 | Takano et al. | |
| 7,842,170 | B1 | 11/2010 | von Detten | |
| 8,444,841 | B2 * | 5/2013 | Haga | 205/118 |
| 2004/0185699 | A1 | 9/2004 | Yang et al. | |
| 2005/0211561 | A1 * | 9/2005 | En | 205/125 |
| 2009/0288955 | A1 * | 11/2009 | Haga | 205/50 |
| 2010/0190390 | A1 | 7/2010 | Yoshida et al. | |
| 2013/0109250 | A1 * | 5/2013 | Haga | 439/816 |

FOREIGN PATENT DOCUMENTS

JP 2006-172877 6/2006

* cited by examiner

*Primary Examiner* — Alexander Gilman
(74) *Attorney, Agent, or Firm* — Gerald E. Hespos; Michael J. Porco; Matthew T. Hespos

(57) ABSTRACT

Convex contact point structures are formed in a compressing portion of a female terminal and hard gold plating is selectively applied only to surfaces of the convex contact point structures. The convex structures are arranged to be able to stably support a male terminal tab, improve electrical connection stability and suppress gold plating abrasion. Hard gold plating is formed in very small ranges with high accuracy by using a laser plating method.

6 Claims, 8 Drawing Sheets

FEMALE TERMINAL FITTING

BACKGROUND OF THE INVENTION

1. Field of the Invention

The invention relates to a female terminal fitting, such as an electrical connection fitting used in a connector of an automotive wiring harness and that can be connected electrically to a male electrical connection fitting.

2. Description of the Related Art

Electrical wiring, such as an automotive wiring harness, conventionally has a compression connection terminal composed of a male terminal with a plate-like tab and a female terminal fitting into which the male terminal tab is inserted. The female terminal fitting has a spring piece that compresses and holds the tab of the male terminal. The male terminal tab and the female terminal fitting are formed of copper alloy or the like. Metal plating often is applied to surfaces to avoid a reduction in connection reliability due to oxidation of contact portions. Gold plating and hard gold plating are excellent in that electrical resistance is low and an increase of an electrical resistance value caused by surface oxide formation is hardly seen even under varying temperature and humidity conditions.

Microscopic uneven structures normally are present on metal surfaces, and the area of true contact where metals are actually in contact is very small as compared with an apparent contact surface at a contact portion of the male terminal fitting and the female terminal fitting. The location of a true contact point on the apparent contact surface is difficult to specify and control when flat metal plates are in contact with each other. As a result, safety and reliability of electrical connection are difficult to guarantee. Some small female terminal fittings sandwich a tab of a male terminal between a resilient contact piece and a contact surface of a non-resilient flat plate that faces the resilient contact piece. However, the position of a true contact point of a flat inner facing contact surface is particularly difficult to specify and control.

A conventional female terminal fitting is shown in FIG. 8. A resilient contact piece 82 includes a dome-shaped embossed contact portion 82*a* that achieves point contact with a male terminal tab 89 shown by imaginary line in FIGS. 8(A) and 8(B), but an inner facing contact surface 81 is flat. Macroscopically, the inner facing contact surface 81 is entirely in contact with the upper surface of the male terminal tab 89. However, a force of the embossed contact portion 82*a* of the resilient contact piece 82 for pressing the male terminal tab 89, i.e. a contact load, should be comparable to a contact load given by the male terminal tab 89 pressing the inner facing contact surface 81. The contact load is a product of a true contact area and a contact stress, and the contact stress is determined by the hardness of a material metal and, when plating is applied, by the hardness of a plating metal.

If the resilient contact piece 82 and the inner facing contact surface 81 are formed of the same base material metal and plating metal, a true contact area on the inner facing contact surface 81 should only be about the same as the area of a top part of the embossed contact portion 82*a* on the resilient contact piece 82 regardless of how large an apparent contact area is. Since the true contact point is formed anywhere on the microscopic contact surface on the inner facing contact surface 81 with uniform possibility, plating conventionally has been applied to the entire inner facing contact surface 81. Applying plating selectively to only the embossed contact portion 82*a* on the resilient contact piece 82 is technically difficult. Thus, plating has been applied to the entire resilient contact piece 82.

U.S. Pat. No. 6,547,608 attempts to solve a problem of being unable to control the position of the true contact point on the flat surface by providing convex contact points on a resilient contact piece and a facing female terminal plate portion and ensuring a point contact or a line contact. U.S. Pat. No. 7,195,495 provides a convex portion on a surface of a female terminal fitting facing a male terminal fitting to apply a concentrated load when inserting and withdrawing the male terminal fitting so that foreign matter sandwiched between the male and female terminal fittings is removed. Japanese Unexamined Patent Publication No. 2006-172877 discloses a step projecting from a receiving portion of a female terminal fitting to be brought into contact with a male tab to solve a problem that plating comes off due to sliding abrasion between male and female terminal fittings. The step is not exposed even if plating is peeled off by applying plating to form a layer thicker than a projection distance of the step.

As disclosed in these references, plating normally has been applied to the entire inner surface even if a convex structure is formed on the inner surface of the female terminal fitting to specify the contact point between the female and male terminal fittings.

As described above, gold plating for improving contact reliability need only be applied in the vicinity of the very small true contact point. Plating applied to other parts increases material cost and facility cost for plating, but does not contribute to contact point formation. The added cost for excess plating is a particular drawback when plating with a precious metal material, such as gold.

SUMMARY OF THE INVENTION

The invention relates to a female terminal fitting that includes at least one resilient contact piece and at least one contact surface for sandwiching and compressing a tab of a male terminal. The resilient contact piece and the contact surface are provided at substantially facing positions. The resilient contact piece is formed with one convex contact that projects in for contacting the male terminal tab. The contact surface is formed with a plurality of convex contacts that project in for contacting the male terminal tab. Hard gold plating is applied only to the top surfaces of the respective convex contacts on the resilient contact piece and the inner facing contact surface.

The convex contacts are provided on the resilient contact piece and the inner facing contact surface, and the hard gold plating is applied only to the top surfaces of the convex contacts. Thus, the plating areas are reduced as compared with the case where plating is applied to the entire facing surfaces of the resilient contact piece and the contact surface. Additionally, high connection reliability is achieved at the contact points while the cost required for plating can be reduced. Expensive gold is used as a plating material. Thus, a cost reduction is particularly notable as compared with the case of plating with a relatively inexpensive metal. Further, the male terminal tab is supported at three or more points by forming one convex contact on the resilient contact piece and plural convex contacts on the inner facing contact surface. As a result, freedom of movement of the male terminal in a compressing portion of the female terminal is limited as compared with the case where the male terminal tab is supported at two points. Therefore, the male terminal can be held stably even in a vibrating environment and plating abrasion due to fine sliding movements between the two terminal fittings is prevented. Furthermore, the thickness of plating layers can be reduced by suppressing plating abrasion thereby further reducing cost for plating.

The convex contacts on the contact surface preferably are formed at positions displaced from the convex contact on the resilient contact piece instead of being directly opposed to the convex contact on the resilient contact piece. Thus, swinging movements of the male terminal tab in the width direction are hindered when the convex contacts are displaced in the width direction of the female terminal fitting, whereas the inserted male terminal tab is deflected in inserting and withdrawing directions and swinging movements in the male terminal inserting and withdrawing directions are hindered when the convex contacts are displaced in the male terminal inserting and withdrawing directions. Thus, the freedom of movement of the male terminal tab is limited and mechanical stability and electrical connection reliability in compressing and holding the male terminal tab are further improved.

Two convex contacts may be formed on the contact surface at opposite sides of the position of the convex contact on the resilient contact piece in a width direction. Thus, swinging movements of the male terminal tab in the width direction are hindered further and the male terminal tab can be held particularly stably.

The two convex contacts on the inner facing contact surface may be closer to an entrance than the convex contact on the resilient contact piece in a male terminal inserting direction. Thus, foreign matter between the female terminal fitting and the male terminal tab can be removed when inserting and withdrawing the male terminal.

Three or more convex contacts may be formed on the contact surface in directions different from each other with the convex contact formed on the resilient contact piece as a center. Thus, the freedom of movement of the male terminal tab is limited further. In this case, if the respective convex contacts are arranged in directions different from each other with the convex contact formed on the resilient contact piece as a center, these three or more convex contacts are not arranged in a straight line and, hence define a plane. This limits the freedom of movement of the male tab more strictly and improves mechanical stability and electrical connection reliability.

The convex contact on the resilient contact piece preferably is a substantially dome-shaped embossed contact. Thus, a point contact between the resilient contact piece and the male terminal tab is achieved reliably and a force exerted to the male terminal tab by resilience of the resilient contact piece is concentrated on one point.

The convex contacts on the contact surface may be long convex contact portions with a substantially arcuate or stepwise cross-section in a width direction and extend substantially parallel to male terminal inserting and withdrawing directions. Thus, swinging movements of the male terminal in the male terminal inserting and withdrawing directions are hindered reliability.

The convex contacts on the resilient contact piece and on the inner facing contact surface may be dome-shaped embossed contacts. Thus, point contacts of the male terminal tab with the resilient contact piece and the contact surface are achieved reliably.

Hard gold plating preferably is applied only in an area having a diameter or an extension of about 0.6 mm or less on the substantially dome-shaped embossed contact on the resilient contact piece and the contact surface and only in an area having a width of about 0.3 mm or less on the convex contacts on the inner contact surface. Thus, plating cost is reduced to a minimum in consideration of terminal fitting working precision.

The invention also relates to a female terminal fitting with facing resilient contact pieces for sandwiching and compressing a tab of a male terminal. The resilient contact pieces are curved at substantially facing positions to form convex contacts. Hard gold plating is applied only in an area having a length of about 0.6 mm or less in a male terminal inserting direction including each convex contact. The cost required for plating can be reduced while electrical connection reliability is improved by selectively applying hard gold plating to convex contacts.

Dome-shaped projections preferably are formed at the curved portions of the resilient contact pieces to define convex contacts and hard gold plating is applied only to the top surfaces of the convex contacts. Accordingly, cost required for plating can be reduced while electrical connection reliability is improved. In this case, hard gold plating preferably is applied only in an area having a diameter or an extension of about 0.6 mm or smaller on the convex contact.

The hard gold plating preferably is formed by a laser plating method. The plating areas can be reduced reliably and precision in plating positions and ranges is increased if hard gold plating is applied by laser plating.

These and other features and advantages of the invention will become more apparent upon reading the following detailed description of preferred embodiments and accompanying drawings. It should be understood that even though embodiments are described separately, single features thereof may be combined to additional embodiments.

BRIEF DESCRIPTION OF THE DRAWINGS

FIGS. 1(A), 1(B) and 1(C) are views of a compressing portion of a female terminal fitting according to a first embodiment of the invention, wherein FIG. 1(A) is a section perpendicular to male terminal inserting and withdrawing directions, FIG. 1(B) is a section parallel to the male terminal inserting and withdrawing directions and FIG. 1(C) is a plan view of an inner facing contact surface when viewed from the interior of the terminal.

DETAILED DESCRIPTION OF THE PREFERRED EMBODIMENTS

Figure 1A:
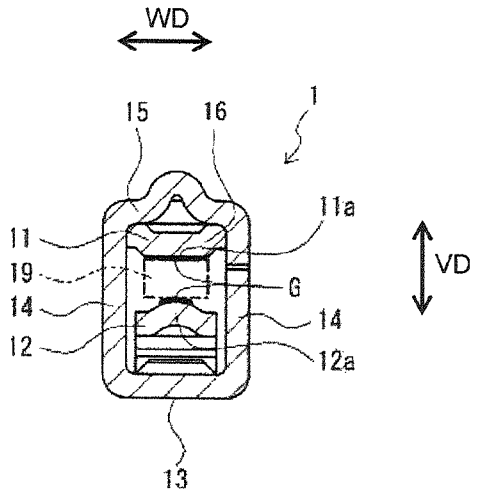
Figure 1B:
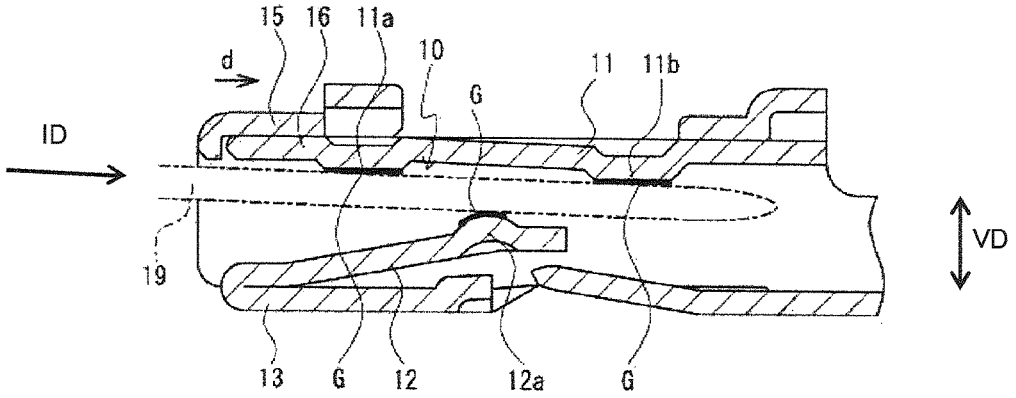

A female terminal fitting 1 according to a first embodiment of the invention is identified by the numeral 1 in FIGS. 1(A) and 1(B) and includes an unillustrated wire connecting portion for connection with at least one wire of a wiring harness or the like at a base end part of a compressing portion 10. A substantially flat terminal tab 19 of a male terminal shown in imaginary line is to be inserted into the compressing portion 10. The flat terminal tab 19 of the male terminal fitting and the female terminal fitting 1 both are made of a conductive metal, such as copper alloy so that a wire connected to a female terminal base end part and a wire connected to a male terminal base end part are connected electrically. Note that, in this description, a width direction WD and a vertical direction VD are respectively a lateral direction and a vertical direction in FIG. 1(A).

The compressing portion 10 of the female terminal fitting 1 is a substantially rectangular tube with an open front end. The tube of the compressing portion 10 has a bottom plate 13, side plates 14, 14 projecting up from left and right sides of the bottom plate 13 and ceiling plates 15, 16 bent from upper ends of the side plates 14, 14. The ceiling plate 16 is inward of the ceiling plate 15 and has an inner facing contact surface 11. A resilient contact piece 12 extends unitarily from the front end of the bottom plate 13 and is folded in and back into the compressing portion 10. The resilient contact piece 12 applies an upward or inward force to the male terminal tab 19 in a direction intersecting an insertion direction ID and toward the inner facing contact surface 11 so that the male terminal tab 19 is pressed against the inner facing contact surface 11. Thus, the male terminal tab 19 is compressed and sandwiched between the resilient contact piece 12 and the inner facing contact surface 11.

Brass, bronze, beryllium copper and copper alloys, such as Corson-based alloy, have excellent electrical conductivity, mechanical strength and workability and are suitable as a base material of the female terminal fitting 1. Further, base plating with nickel or the like preferably is applied to substantially the entire facing surfaces of the resilient contact piece 12 and the inner facing contact surface 11 for preventing corrosion of the base material and diffusion of copper atoms from the base material into a hard gold plating layer to be described later.

A substantially dome-shaped embossed contact 12*a* projects from the surface of the resilient contact piece 12 opposed to the inner facing contact surface 11. A top part of the dome-shaped contact 12*a* achieves point contact with the male terminal tab 19. Specifically, the dome-shaped embossed contact 12*a* is formed by embossing a part of a plate material of the resilient contact piece 12 into a dome shape from below. The size of the dome-shaped embossed contact 12*a* is not restricted. Widths of resilient contact pieces in a small terminal used in an automotive vehicle generally are in a range between about 0.5 mm to about 1.0 mm (e.g. about 0.8 mm). If the resilient contact piece 12 has a width of less than about 1.0 mm, a diameter of a bottom part of the dome shape preferably is no more than ¾ the width of the resilient contact piece 12. Specifically, if the resilient contact piece 12 has a width of about 0.8 mm, a diameter of a bottom part of the dome shape preferably is about 0.6 mm or smaller.

The dome-shaped embossed contact 12*a* desirably is formed at a position substantially bisecting the resilient contact piece 12 in the width direction WD for mechanically holding the male terminal tab 19 stably in cooperation with the inner facing contact surface 11.

Two substantially trapezoidal step-like contacts 11*a*, 11*b* are formed on the inner facing contact surface 11 and project toward the resilient contact piece 12 in a step-like manner. The step-like contacts 11*a*, 11*b* are formed by press working to define steps parallel to the width direction WD of the inner facing contact surface 11. The inner facing contact surface 11 comes into contact with the male terminal tab 19 at the step-like contacts 11*a*, 11*b*. Thus, unlike the conventional female terminal fitting of FIG. 8(B) where the contact point on the flat inner facing contact surface 81 cannot be specified, the contact points are limited to the step-like contacts 11*a*, 11*b* in the female terminal fitting of this embodiment. The arrangement of the two step-like contacts 11*a*, 11*b* is not particularly limited, but here they are located at positions distant from the position of the dome-shaped embossed contact portion 12*a* on the resilient contact piece 12 in male terminal inserting and withdrawing directions.

Hard gold plating layers G are formed on the resilient contact piece 12 and the inner facing contact surface 11 to enhance reliability in electrical connection at the contact points. Gold is adopted as a plating metal since it is chemically stable and not oxidized even under varying temperature and humidity conditions and maintains a state where electrical resistance is low. Hardness is insufficient if only gold is used. Thus, cobalt is added to gold to obtain a hard gold plating.

The hard gold plating layer G is formed only on the top or distal surface of the dome-shaped embossed contact 12*a* on the resilient contact piece 12 and not formed on other parts. Further, the gold plating layers G are formed only on the step-like contacts 11*a*, 11*b* on the inner facing contact surface 11 and not formed on other parts. The gold plating layer G may be formed on the entire surfaces of these projecting parts 12*a*, 11*a*, 11*b* or may be formed on only parts of the surfaces if these parts include top parts which serve as contact points with the male terminal tab 19.

Figure 8A:
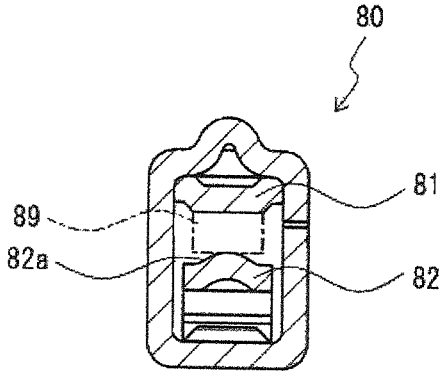
FIG. 8(A) is a section perpendicular to male terminal inserting direction of a compressing portion of a conventional female terminal fitting and FIG. 8(B) is a section parallel to the male terminal inserting direction.
Figure 8B:
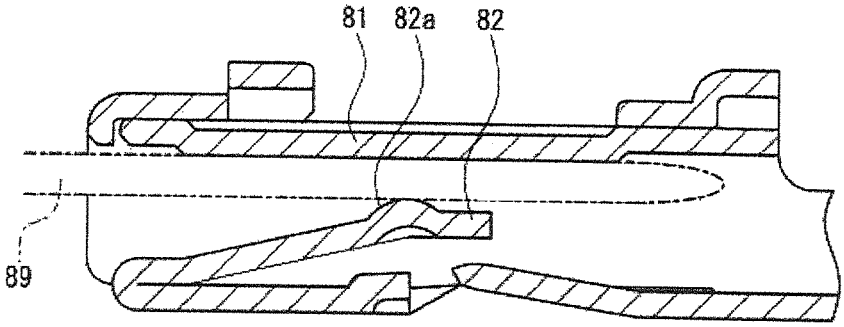

The location of the true contact point on the inner facing contact surface 81 the true contact point cannot be specified in the conventional female terminal fitting of FIGS. 8(*a*) and 8(*b*). Thus, plating must be applied at least to the entire inner facing contact surface 81. On the other hand, hard gold plating is applied only to parts where the contact points are formed in this embodiment of the invention so that the amount of the plating material is less. The laser plating method described herein also can reduce equipment cost for laser operation.

Cost is reduced as the area of the gold plating layer G is reduced. However, plating must be applied over an area of a certain extent in consideration of working precision. A position gap between press working and plating is at most about 0.1 mm. Thus, the hard gold plating layers G should be formed in top areas of the substantially convex or step-like structures and their neighboring areas including gap buffer (absorption) areas having a width of about 0.1 mm to ensure that the hard gold plating layers G are at positions where convex structures, such as the dome-shaped embossed contact 12*a* and the step-like contacts 11*a*, 11*b* are formed.

The convex contacts on the inner facing contact surface could be narrow in the width direction WD and aligned in a straight line with the dome-shaped embossed contact portion on the resilient contact piece. However, the inserted male tab would have a degree of freedom of swinging about the straight line in a clearance in the compressing portion of the female terminal fitting in a vibrating environment. Thus, reliable mechanical connection stability and electrical connection is reduced and the hard gold plating layers of the contact portions may be abraded due to fine sliding movements between the contact portions of the female terminal fitting and the male terminal tab.

On the other hand, the two wide step-like contacts 11*a*, 11*b* in this embodiment are formed on the inner facing contact surface 11 at positions displaced from the dome-shaped embossed contact 12*a* on the resilient contact piece 12. Thus, the male terminal tab 19 is supported at three positions to hinder swinging movements of the male terminal tab 19. Further, the male terminal tab 19 is deflected at these three supporting points for further suppressing movements of the male terminal tab 19. Therefore, the male terminal tab 19 is held mechanically stably, is difficult to withdraw, and is not likely to swing in the compressing portion 10, even in a vibrating environment. The absence of such swinging movements suppresses unstable electrical contact and plating abrasion due to fine sliding movements between the male terminal tab 19 and the contact points of the female terminal fitting 1.

The suppression of plating abrasion enables the thickness of the hard gold plating layers G to be less than about 0.6 μm, e.g. about 0.4 μm, thereby further reducing costs.

Figure 1C:
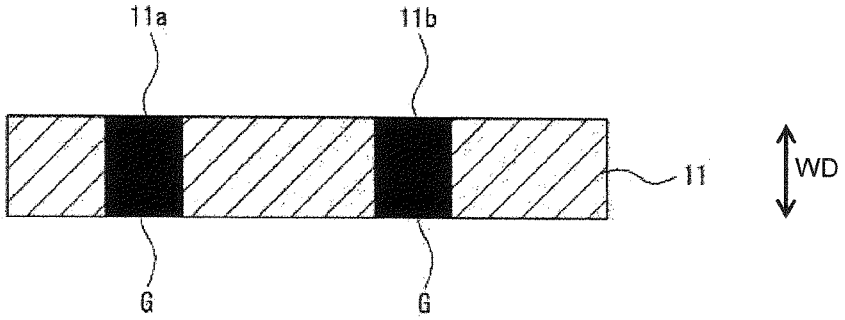
Figure 2A:
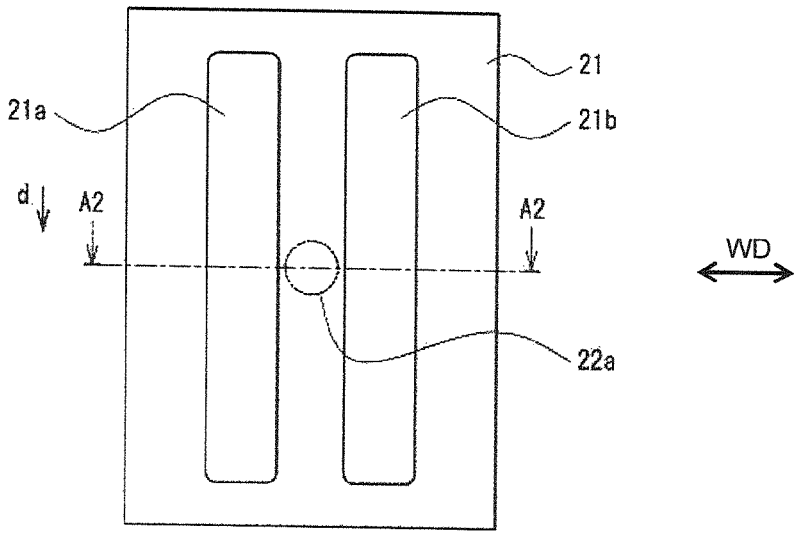
FIGS. 2(A) and 2(B) are respectively a plan view and a perspective view of an inner facing contact surface of a compressing portion of a female terminal fitting according to a second embodiment when viewed from the interior of the terminal and FIG. 2(C) is a section along A2-A2 with a male terminal tab compressed and held.
Figure 2B:
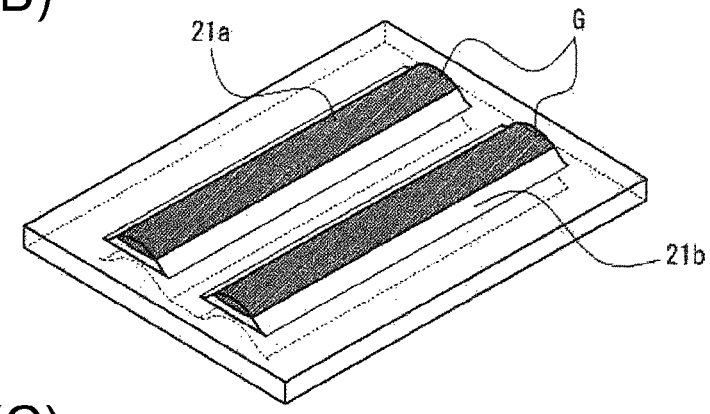
Figure 2C:
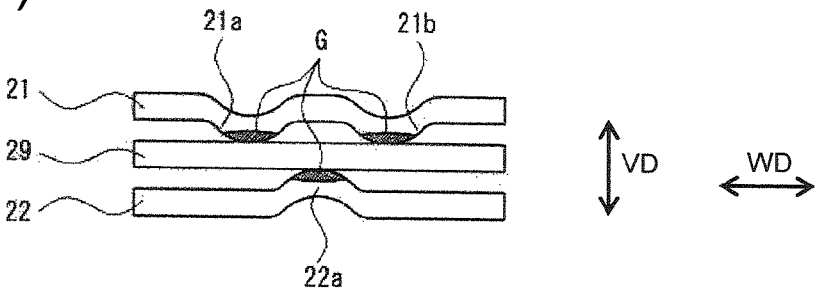

A female terminal fitting according to a second embodiment is shown in FIGS. 2(A) and 2(B) and has a resilient contact piece 22 with a dome-shaped embossed contact 22*a* at a position bisecting the resilient contact piece 22 in the width direction WD, as in FIG. 1. A hard gold plating layer G is applied only on the top surface of the dome-shaped embossed contact 22*a*. The resilient contact piece 22 achieves point contact with a male terminal tab 29 at a tip of the dome-shaped embossed contact 22*a*. The gold plating layer G is not shown in FIG. 2(A), 3(A), 4(A) or 5(A).

Two elongate convex contact portions 21*a*, 21*b* extend parallel to male terminal inserting and withdrawing directions on the inner facing contact surface 21 and have top parts that are arcuately convex in the width direction WD. The arcuate top parts of the convex contacts 21*a*, 21*b* come into point contact with the male terminal tab. The convex contacts 21*a*, 21*b* are formed by embossing long and narrow parts of the inner facing contact surface 21 from below. If the inner facing contact surface is about 0.8 mm wide, which is the width of a general small terminal for automotive vehicle, the width of bottom parts of the convex contacts 21*a*, 21*b* should be less than about half (e.g. about 0.4 mm or smaller).

The two convex contacts 21*a*, 21*b* are substantially parallel and are at opposite sides of the position of the dome-shaped embossed contact 22*a* on the resilient contact piece 22 in the width direction WD. Hard gold plating layers G are formed only on the top surfaces of the convex contacts 21*a*, 21*b*. The gold plating layers G may be formed on the entire top surfaces of the convex contacts 21*a*, 21*b* or only on parts of the top surfaces if these parts include the arcuate top parts.

The convex contacts 21*a*, 21*b* are long in the male terminal inserting and withdrawing directions and hence suppress vertical movements of the male terminal tab in a direction substantially perpendicular to the male terminal inserting and withdrawing directions. Further, the convex contacts 21*a*, 21*b* are bilaterally symmetrical with respect to the dome-shaped embossed contact portion 22*a* on the resilient contact piece, as in FIGS. 2(A) and 2(B), to hold the male terminal tab stably in a well-balanced manner in cooperation with the dome-shaped embossed contact 22*a*.

The hard gold plating layers G are formed only on the surfaces of the dome-shaped embossed contact 22*a* on the resilient contact piece 22 and the convex contacts 21*a*, 21*b* on the inner facing contact surface 21. Thus, the plating cost is suppressed while reliable electrical connection is achieved at each contact point. A position gap between press working and plating is at most about 0.1 mm. Hence, hard gold plating G preferably is applied in an area having a diameter or an extension of about 0.6 mm on the top part of the dome-shaped embossed contact 22*a* on the resilient contact piece 22 and in areas having a dimension of about 0.3 mm in the width direction WD for the convex contacts 21*a*, 21*b* on the inner facing contact surface 21. The thickness of the hard gold plating layers G can be less than about 0.6 μm (e.g. about 0.4 μm) because abrasion is suppressed by preventing sliding movements between the male and female terminal fittings, as described in the first embodiment. The shapes of the dome-shaped embossed contact 22*a* and the convex contacts 21*a*, 21*b* and the ranges of the hard gold plating layers G are substantially the same as in the following third to fifth embodiments.

Figure 3A:
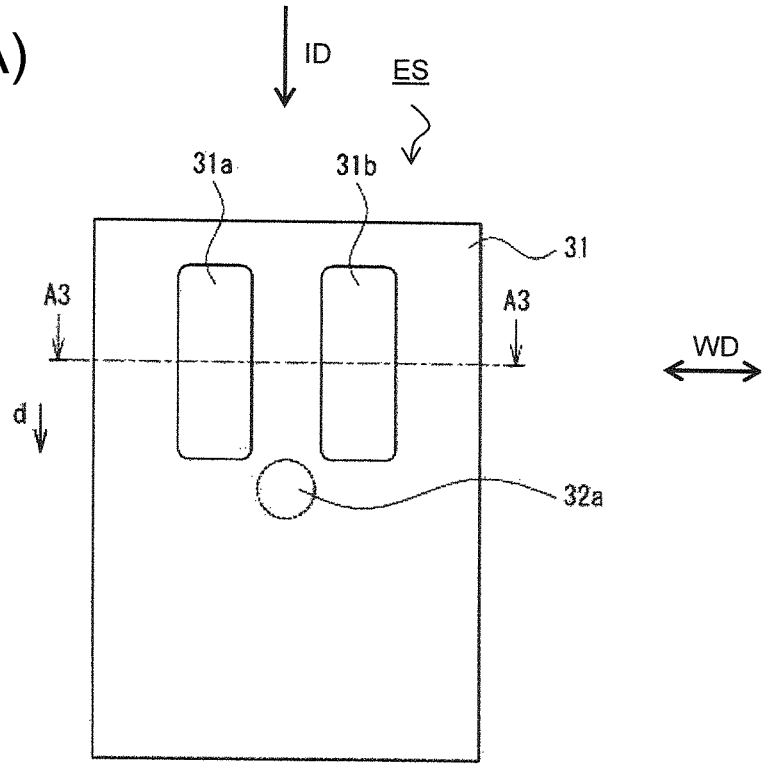
FIG. 3(A) is a plan view of an inner facing contact surface of a compressing portion of a female terminal fitting according to a third embodiment of the invention when viewed from the interior of the terminal and FIG. 3(B) is a section along A3-A3 in a state where a male terminal tab is compressed and held.
Figure 3B:
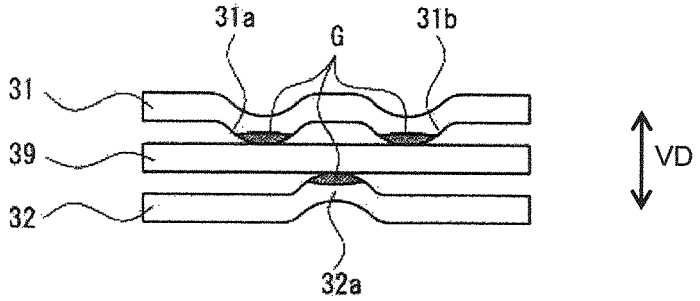

FIGS. 3(A) and 3(B) show a female terminal fitting where the lengths of convex contacts on an inner facing contact surface are made shorter for further reducing the areas of the gold plating layers G and reducing cost for plating even more. This embodiment is possible when a base end part of a male terminal tab 39 is fixed so as not to move toward a resilient contact piece of a female terminal fitting so that the male terminal is held reliably. Two convex contacts 31*a*, 31*b* are provided on an inner facing contact surface 31 to be closer to an entrance side ES than the position of a dome-shaped embossed contact 32*a* on a resilient contact piece 32 in a terminal inserting direction ID. The male terminal tab 39 is supported by the convex contacts 31*a*, 31*b* and the dome-shaped embossed contact 32*a* at three positions in a non-linear array to hold the male terminal tab 39 mechanically stably.

The convex contacts 31*a*, 31*b* scrape a surface of the male terminal tab 39 with a load concentrated on top parts of the convex contacts 31*a*, 31*b* when inserting the male terminal tab 39. Thus, foreign matter adhering between the male terminal tab 39 and the inner facing contact surface 31 is moved toward a base end of the male terminal tab 39. The two convex contacts 31*a*, 31*b* are side by side in the width direction WD at the entrance ES in the male terminal inserting direction to enhance the foreign matter removal effect. A sliding distance becomes longer than in the case where contact portions are at a back end in the male terminal inserting direction ID and a foreign matter can be ejected more easily and also discharged into a space between the two convex contact portions.

Figure 4A:
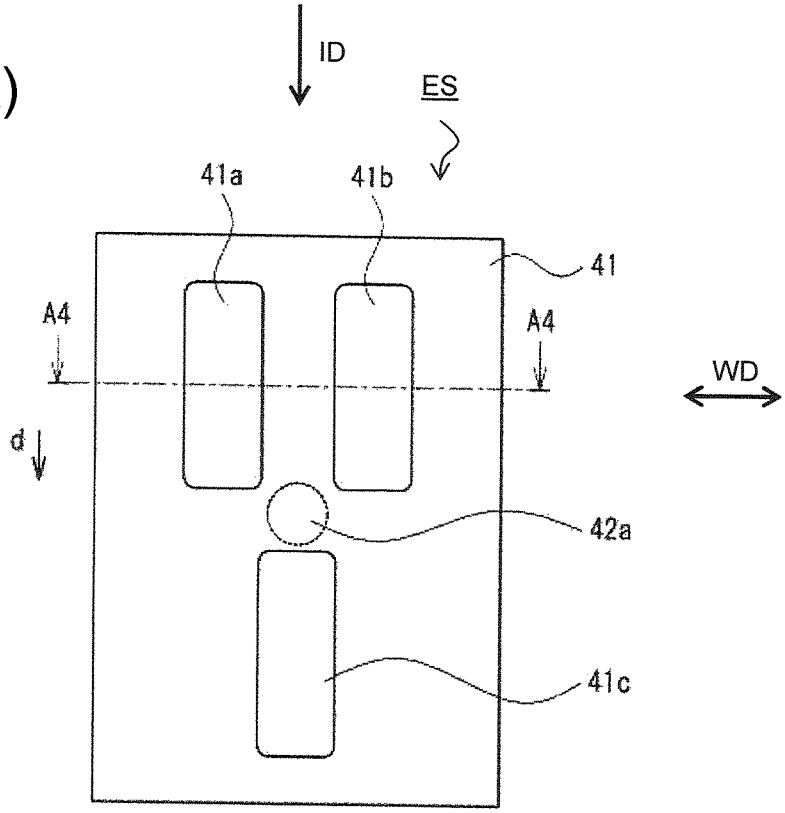
FIG. 4(A) is a plan view of an inner facing contact surface of a compressing portion of a female terminal fitting according to a fourth embodiment of the invention when viewed from the interior of the terminal and FIG. 4(B) is a section along A4-A4 in a state where a male terminal tab is compressed and held.
Figure 4B:
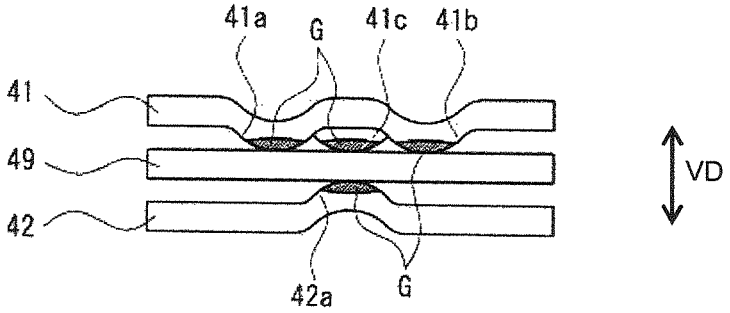

Short convex contacts at the entrance side in the terminal inserting direction on the inner facing contact surface may not support the male tab with sufficient mechanical stability if a base end of the male terminal tab can move toward the resilient contact piece of the female terminal fitting. The fourth embodiment shown in FIGS. 4(A) and 4(B) addresses this situation by providing two convex contacts 41*a*, 41*b* on a resilient contact piece 42 at an entrance side ES of the position of the dome-shaped embossed contact 42*a* and one convex contact 41*c* at a back side of the position of a dome-shaped embossed contact 42*a*. The three convex contacts 41*a*, 41*b* and 41*c* and the dome-shaped embossed contact 42*a* on the resilient contact piece 42 support a male terminal tab 49 at four positions to improve holding stability of the male terminal tab 49 as compared with the case where only two convex contacts are formed. The three convex contacts 41*a*, 41*b* and 41*c* are not in a straight line and hence form a plane that supports the upper surface of the male terminal tab 49 to achieve high mechanical stability. Further, the three convex contacts 41*a*, 41*b* and 41*c* form an isosceles triangle around the position of the dome-shaped embossed contact 42*a* on the resilient contact piece 42. Thus, the male terminal tab 49 is supported in a well-balanced manner in both the male terminal inserting and withdrawing directions (ID) and the width direction WD.

Figure 5A:
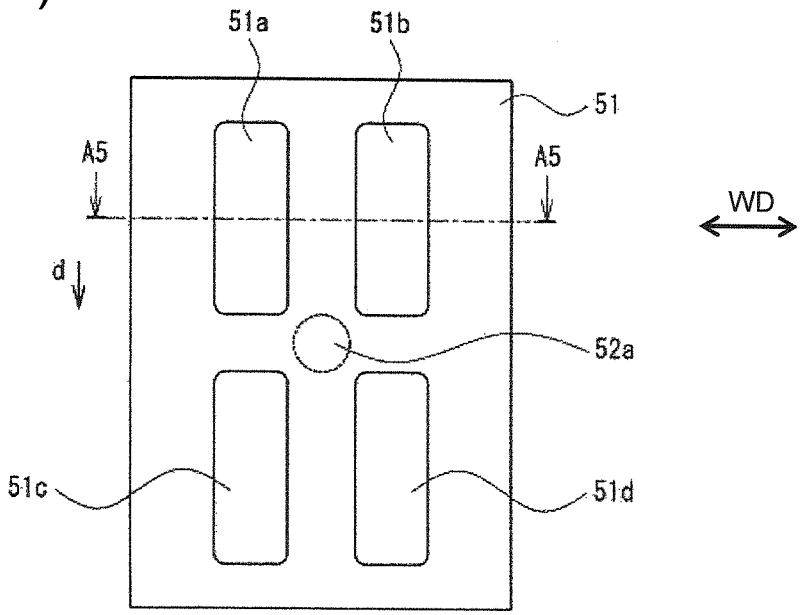
FIG. 5(A) is a plan view of an inner facing contact surface of a compressing portion of a female terminal fitting according to a fifth embodiment of the invention when viewed from the interior of the terminal and FIG. 5(B) is a section along A5-A5 in a state where a male terminal tab is compressed and held.
Figure 5B:
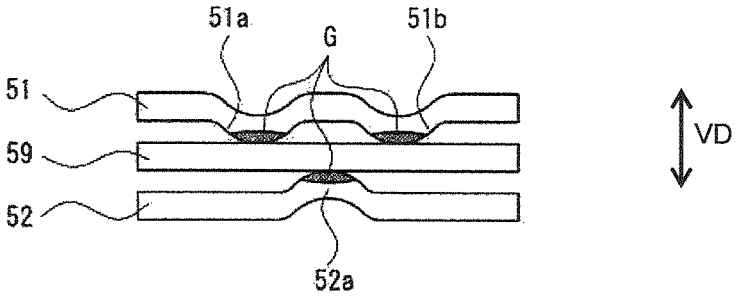

A female terminal fitting according to a fifth embodiment is shown in FIG. 5, and has four convex contacts formed on an inner facing contact surface. Thus, a male terminal tab 59 is supported at a total of five positions, namely a substantially dome-shaped embossed contact 52*a* on a resilient contact piece 52 and at four convex contacts 51*a*, 51*b*, 51*c* and 51*d* on an inner facing contact surface, thereby further improving holding stability of the male terminal tab 59. Additionally, the four convex contacts 51*a*, 51*b*, 51*c* and 51*d* are arranged to form a rectangle centered on the position of the dome-shaped embossed contact 52*a* on the resilient contact piece 52 to support the male terminal tab 59 in a well-balanced manner in all directions.

The convex contacts on the inner facing contact surface in the third to fifth embodiments may be pointed or dome-shaped embossed contacts similar to the one formed on the resilient contact piece.

Selective application of hard gold plating only to convex contacts can be applied for female terminal fittings of a type to compress and hold a male terminal tab between a resilient contact piece and an inner facing contact surface with no resilience, and also for female terminal fittings that compress and hold a male terminal tab between a pair of resilient contact pieces.

The above-described convex contacts 11*a-b*; 21*a-b*; 31*a-b*; 41*a-c*; 51*a-d* on the inner facing contact surface 11; 21; 31; 41; 51 are at positions displaced from the convex contact 12*a*; 22*a*; 32*a*; 42*a*; 52*a* formed on the resilient contact piece 12; 22; 32; 42; 52. In other words, when seen in the plan view (see FIGS. 2(A), 3(A), 4(A) and 5(A)) the convex contacts 11*a-b*; 21*a-b*; 31*a-b*; 41*a-c*; 51*a-d* formed on the inner facing contact surface 11; 21; 31; 41; 51 do not overlap the convex contact 12*a*; 22*a*; 32*a*; 42*a*; 52*a* formed on the resilient contact piece 12; 22; 32; 42; 52.

Figure 6A:
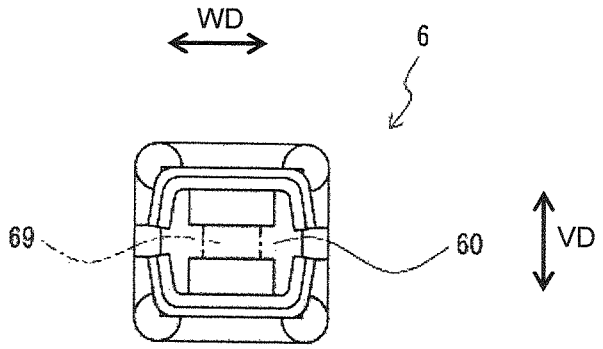
FIG. 6(A) is a front view of a male terminal insertion opening of a compressing portion of a female terminal fitting according to a sixth embodiment and FIG. 6(B) is a section in a direction parallel to male terminal inserting direction.
Figure 6B:
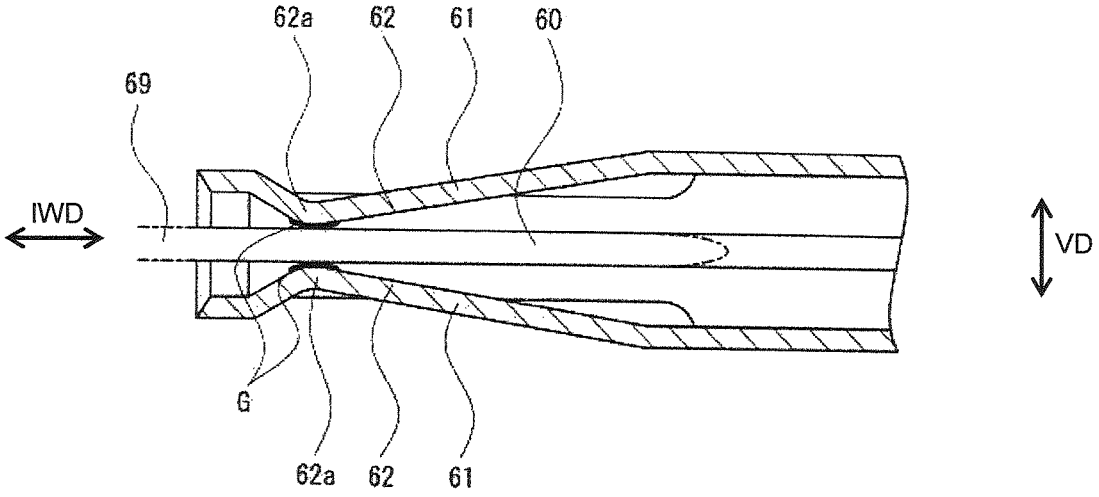

FIGS. 6(A) and 6(B) show a compressing portion 60 of a female terminal fitting 6 according to a sixth embodiment. The female terminal fitting 6 has two resilient contact pieces 61, 61. The resilient contact pieces 61, 61 are formed with curves 62 curved in directions toward the other resilient contact pieces at substantially facing positions near leading ends, and tips or distal parts of the curves 62, 62 define convex contacts 62*a*, 62*a*. Specifically, the resilient contact pieces 61, 62 are held in line contact with a male terminal tab 69 at the convex contacts 62*a*, 62*a*.

The resilient contact pieces 61, 61 are formed of copper alloy as a base material, base plating with nickel or the like is applied to the base material, and hard gold plating layers G are formed on the convex contacts 62*a*, 62*a* to maintain high electrical connection reliability even under varying temperature and/or humidity conditions. The hard gold plating layers G are applied selectively only to and near the convex contacts 62*a*, 62*a* because other parts of the resilient contact pieces 61, 61 do not contribute to contact point formation. The hard gold plating layers G are formed entirely in a width direction WD of the resilient contact pieces 61, 61, but are formed only in parts having a length of between about 0.8 mm and about 0.4 mm (particularly about 0.6 mm) in male terminal inserting and withdrawing directions IWD. The length of about 0.6 mm was determined from working precision of the female terminal fitting to be described later. The thickness of the hard gold plating layers G preferably is less than about 0.6 μm (particularly about 0.4 μm). By forming the hard gold plating layers G only near the convex contacts 62*a*, 62*a* in this way, plating cost is reduced as compared with applying hard gold plating to entire facing surfaces of the resilient contact pieces 61, 61, while high electrical connection reliability is achieved even in a vibrating environment and in a varying temperature and humidity environment.

Figure 7:
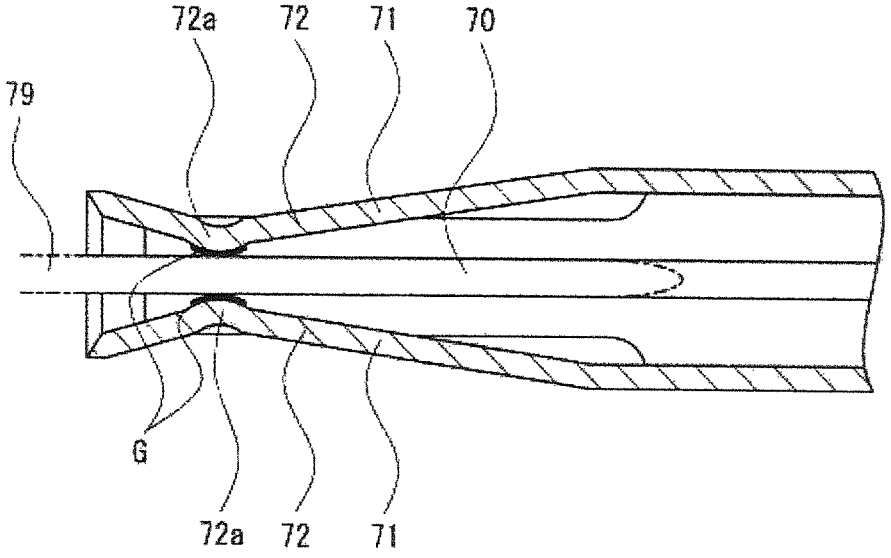
FIG. 7 is a section of a compressing portion of a female terminal fitting according to a seventh embodiment of the invention in a direction parallel to male terminal inserting and withdrawing directions.

FIG. 7 shows a compressing portion 70 of a female terminal fitting 7 according to a seventh embodiment and has two resilient contact pieces 71, 71 curved in facing directions at substantially facing positions similar to the compressing portion 60 of the female terminal fitting 6 of FIG. 6. Curves 72, 72 at the resilient contact pieces 71, 71 include substantially dome-shaped projections projecting farther in directions toward the other resilient contact pieces, and these projections define embossed contacts 72*a*, 72*a*. The respective resilient contact pieces 71, 71 are held in substantially point contact with a male terminal tab 79 at the dome-shaped embossed contacts 72*a*, 72*a*.

Hard gold plating layers G are formed on the dome-shaped embossed contacts 72*a*, 72*a* to maintain high electrical connection reliability even under varying temperature and humidity conditions. The hard gold plating layers G are formed only on distal surfaces of the dome-shaped embossed contacts 72*a*, 72*a*. The hard gold plating layers G may be formed on the entire top surfaces of the dome-shaped embossed contacts 72*a*, 72*a* or may be formed in partial areas including the tips of embossments.

A load concentrates more on contact points where point contacts are formed as compared with the case where the curved portions serve as the convex contacts as shown in FIG. 6. A male terminal can be held more stably by forming the convex contacts into dome shapes. Further, the areas of the hard gold plating layers G are reduced, thereby reducing the cost required for hard gold plating.

A female terminal fitting used in an automotive vehicle has become very small with the complication of electrical wiring. Widths of a resilient contact piece and an inner facing contact surface are about 0.8 mm in a typical small terminal. A laser plating method preferably is used for precisely applying hard gold plating in very small areas in the order of about 0.1 mm on convex structures formed in areas on the resilient contact piece and the inner facing contact surface. A method using a mask and other methods are known for applying metal plating in a limited area, but applying plating precisely in such minute areas is difficult using known methods other than the laser plating method.

To produce female terminal fittings, base plating is applied first with nickel or the like to a greater part or to substantially the entirety of a long thin strip material although it is not shown. This continuous material with base plating then is arranged in a hard gold plating solution and gold plating is applied by selectively irradiating a laser spot at specified positions that will function as convex contacts of each female terminal fitting. After the convex contacts are formed by embossing and press working at the positions where hard gold plating was applied, and the material is formed into a desired shape by punching, bending, folding, hammering and the like.

An electrolytic plating method or an electroless plating method may be used to apply hard gold plating in a very small area selected on the continuous material. Spot plating is applied in a part whose temperature is increased locally by irradiating a condensed laser beam to a position desired to be plated. A detailed plating method that may be applied is disclosed in Japanese Unexamined Patent Publication No. 2008-38202, the content of which is included herein by reference. An essential configuration is described below.

A flow path for a plating solution is formed in a plating bath, the above-described continuous material is arranged in that flow path and a laser beam is irradiated. The laser beam preferably is in the range from near-ultraviolet to blue light having a wavelength of about 300 nm or longer and/or about 450 nm or shorter so that the laser beam is not absorbed by cobalt ions included in the plating solution for hard gold plating, but is absorbed by nickel of base plating and plated gold. Specifically, various semiconductor lasers may be used.

The shape of the laser spot may be the shape of an area desired to be plated. That is, a plurality of laser light sources may be used, respective beams may be caused to be incident on optical fibers by collimator lenses, and the optical fibers may be bundled to form a fiber array so that a cross-section becomes the shape of a part desired to be plated. For example, to apply plating to a dome-shaped embossed contact portion on a resilient contact piece of a female terminal fitting, the fibers may be arranged in a substantially circular manner and bundled. To apply plating to a convex contact on an inner facing contact surface, the fibers may be arranged in a substantially rectangular manner and bundled. Further, in the female terminal fitting of the invention, plating needs to be applied in a plurality of shapes at a plurality of positions such as at the position of the dome-shaped embossed contact on the resilient contact piece and a plurality of convex contacts on the inner facing contact surface. Plating can be completed simultaneously with one laser irradiation by arranging fiber arrays at specified positions and simultaneously irradiating laser beams. Two or more laser irradiation devices may be used when plating patterns are necessary on both sides of a thin strip material.

Further, plating can be applied continuously to a multitude of terminal fittings in a developed form by repeating a process of feeding the continuous material in the flow path of the plating bath, irradiating laser beams onto plating positions of one terminal fitting while scanning laser spots in synchronization with a feeding speed of the continuous material, returning the laser spot to a scan start position and irradiating laser beams onto plating positions of the next terminal fitting.

Hard gold plating layers can be formed with high position accuracy by: providing positioning holes near the plating positions of each female terminal fitting; detecting the locations of the positioning holes, such as through detection of light passing through the positioning holes; and irradiating laser beams at specified relative positions based on the locations of the positioning holes. The positioning holes also can be used as a basis for working positions in a subsequent machining process. Using the common positioning holes in the laser plating process and in the machining process enables the positions of the hard gold plating layers and the convex structures to be matched.

Laser plating precision by the above method is about 0.05 mm and precision of machining, such as press working and bending, is about 0.01 mm. Accordingly, a hard gold plating layer applied only in an area of about 0.1 mm or smaller for the convex contact may be displaced from the top part of the convex contact. On the other hand, a hard gold plating applied in a range of about 0.3 mm or about 0.6 mm including a position that becomes a top part of the convex structure avoids a position gap between the hard gold plating layer and the contact point after the subsequent machining.

The invention is not limited to the above embodiments and various changes can be made without departing from the scope of the invention. Particularly, the shapes and arrangements of the convex contacts and the female terminal fitting production method are not limited to the above-described embodiments. For example, the convex contacts on the inner facing contact surface also may be formed into dome shapes similar to the convex contact on the resilient contact piece as described above. Five or more convex contacts may be formed on the inner facing contact surface.

What is claimed is:

1. A female terminal fitting, comprising:

at least one resilient contact piece;

at least one inner facing contact surface facing the resilient contact piece;

a substantially dome-shaped embossed convex contact formed on the resilient contact piece and projecting toward the inner facing contact surface;

a plurality of long convex contacts formed on an inner facing contact surface, the long convex contacts extending substantially parallel to male terminal inserting and withdrawing directions and projecting toward the resilient contact piece, the convex contacts on the inner facing contact surface are at positions displaced from the convex contact on the resilient contact piece; and hard gold plating applied only in an area having a diameter of about 0.6 mm or less on an apex of the dome-shaped embossed convex contacts formed on the resilient contact piece and only in an area having a width of about 0.3 mm or less on the long convex contacts on the inner facing contact surface.

2. The female terminal fitting of claim 1, wherein two convex contacts are formed on the inner facing contact surface and are at opposite sides of the convex contact on the resilient contact piece in a width direction.

3. The female terminal fitting of claim 2, wherein the two convex contacts on the inner facing contact surface are closer to an entrance than the convex contact on the resilient contact piece in a male terminal inserting direction.

4. The female terminal fitting of claim 1, wherein three or more convex contacts are formed on the inner facing contact surface in a non-linear array substantially centered on the convex contact on the resilient contact piece.

5. The female terminal fitting of claim 1, wherein the hard gold plating is formed by laser plating.

6. The female terminal fitting of claim 1, wherein the plurality of long convex contacts comprise two front long contacts closer to an entrance of the terminal fitting than the dome-shaped convex contact on the resilient contact piece and two rear long contact portions farther from the entrance of the terminal fitting than the dome-shaped convex contact on the resilient contact piece.

* * * * *